US009193492B2

(12) United States Patent
Cooper

(10) Patent No.: US 9,193,492 B2
(45) Date of Patent: Nov. 24, 2015

(54) METHOD OF APPLYING NOTCHED FASTENER STOCK

(71) Applicant: William J. Cooper, Natick, MA (US)

(72) Inventor: William J. Cooper, Natick, MA (US)

(73) Assignee: Avery Dennison Corporation, Glendale, CA (US)

( * ) Notice: Subject to any disclaimer, the term of this patent is extended or adjusted under 35 U.S.C. 154(b) by 0 days.

(21) Appl. No.: 14/188,196

(22) Filed: Feb. 24, 2014

(65) Prior Publication Data

US 2014/0165363 A1 Jun. 19, 2014

Related U.S. Application Data

(60) Division of application No. 13/413,287, filed on Mar. 6, 2012, now Pat. No. 8,695,799, which is a continuation-in-part of application No. PCT/US2011/062189, filed on Nov. 28, 2011.

(60) Provisional application No. 61/420,856, filed on Dec. 8, 2010.

(51) Int. Cl.
*B65C 7/00* (2006.01)
*G09F 3/14* (2006.01)

(52) U.S. Cl.
CPC . *B65C 7/005* (2013.01); *G09F 3/14* (2013.01); *Y10T 29/49833* (2015.01); *Y10T 29/49947* (2015.01)

(58) Field of Classification Search
CPC ..... G09F 3/14; B65C 7/00; B65C 7/005
USPC ..... 206/343, 346; 227/19, 67, 68, 120
See application file for complete search history.

(56) References Cited

U.S. PATENT DOCUMENTS 3,875,648 A * 4/1975 Bone ..... 227/19
4,039,078 A 8/1977 Bone (Continued)

FOREIGN PATENT DOCUMENTS

GB 2053296 8/1982
WO 94/10044 5/1994

OTHER PUBLICATIONS

International Preliminary Report on Patentability dated Mar. 4, 2013 for International Application No. PCT/US11/062189 filed Nov. 28, 2011.

(Continued)

*Primary Examiner* — Bryon Gehman
(74) *Attorney, Agent, or Firm* — Avery Dennison Retail Information Services LLC

(57) ABSTRACT

An improved fastener stock comprised of a pair of longitudinal and continuous side members which are coupled to a plurality of equidistantly spaced cross-pieces. The pair of longitudinal and continuous side members are extended in a parallel spaced relationship, and the series of cross-pieces are arranged at spaced intervals between the side members so as to connect the side members. Along at least one of the side members, a series of engagement notches are present at spaced intervals between each of the cross-pieces members, and the engagement notches are rectangular or square in shape. A method of applying a fastener to an article is provided. The method includes initially feeding substantially continuous fastener stock from a supply, engaging at least one engagement notch, urging the fastener stock forward, feeding the fastener stock to a needle assembly, cutting a fastener from the fastener stock, and inserting the fastener into an article.

16 Claims, 9 Drawing Sheets

(56) References Cited

U.S. PATENT DOCUMENTS

| | | | | |
|---|---|---|---|---|
| 4,111,347 | A * | 9/1978 | Bone | 227/68 |
| 4,288,017 | A * | 9/1981 | Russell | 227/67 |
| 4,456,123 | A * | 6/1984 | Russell | 206/343 |
| 4,456,161 | A * | 6/1984 | Russell | 227/67 |
| 4,712,677 | A | 12/1987 | Russell | |
| 4,955,475 | A * | 9/1990 | McCarthy et al. | 206/346 |
| 5,931,298 | A | 8/1999 | Huang | |
| 6,220,434 | B1 | 4/2001 | Kubota et al. | |
| 6,564,939 | B1 * | 5/2003 | Deschenes et al. | 206/343 |
| 6,569,369 | B2 * | 5/2003 | Shilale et al. | 264/167 |
| 7,308,983 | B2 | 12/2007 | Shilale et al. | |
| 7,681,730 | B2 | 3/2010 | Cooper et al. | |

OTHER PUBLICATIONS

Written Opinion dated Feb. 4, 2013 for International Application No. PCT/US11/062189 filed Nov. 28, 2011.

International Search Report dated Feb. 6, 2012 for International Application No. PCT/US11/062189 filed Nov. 28, 2011.

Written Opinion dated Feb. 6, 2012 for International Application No. PCT/US11/062189 filed Nov. 28, 2011.

* cited by examiner

METHOD OF APPLYING NOTCHED FASTENER STOCK

CROSS-REFERENCE TO RELATED APPLICATIONS

The present application is a Continuation-in-Part of International Application Number PCT/US2011/062189 filed Nov. 28, 2011 which claims priority from U.S. Provisional Application No. 61/420,856 filed Dec. 8, 2010, which is incorporated herein by reference in its entirety.

FIELD OF THE INVENTION

The present invention generally relates to fasteners and fastening systems, and in particular to fasteners or staples and a fastener stock configured for enabling enhanced precision and uniformity in the feeding of the fasteners to a needle assembly of a fastening system.

BACKGROUND OF THE INVENTION

Plastic fasteners or elastic staples having a flexible filament connecting enlarged side members thereof are becoming increasingly popular alternatives for attachment and securing a variety of different articles, particularly in retail and other, similar applications. For example, it has now become common for plastic fasteners to be used to attach product labels, price tags or other materials to fabric materials such as garments and apparel items. Alternatively, plastic fasteners are used as a means of securing a product or item to a hang tag or similar packaging without having to fully encapsulate the product within the packaging. Plastic or elastic fasteners can enable the products to be securely fastened to product packaging or tags without the risk of injury or damage to the product from the use of metal staples having sharp edges. In addition, the cost of the plastic fasteners typically is substantially less than other packaging methods such as metal staples, cable ties and/or twist ties.

Such plastic fasteners generally are applied or inserted using a fastener dispensing tool or system. Such fastener dispensing systems include hand operating tools, often referred to as "tagging guns," and automated stapling equipment which feed and cut the fasteners from a continuously connected fastener stock supply to a needle assembly for insertion of the fasteners into an article, such as an article of clothing, etc. For example, U.S. Pat. Nos. 4,039,078 and 4,121,487 illustrate continuously connected fastener stocks and systems for dispensing plastic fasteners from such fastener stock. As indicated in these patents, the fastener stock generally is formed with a ladder-like structure including elongated side members with filaments extending therebetween at spaced intervals. The fastener stock generally can be fed or wound about a supply roll and will be fed by a feed mechanism to the needle assembly of the fastener dispensing system, whereupon the fasteners will be separated or cut away from the stock and inserted into the article.

In conventional systems, the feed mechanism for feeding the fastener stock to the needle assembly of the fastener dispensing system generally comprises a feed wheel or similar rotary mechanism that engages the filaments extending between the side members and pulls or urges the fastener stock forwardly to feed a next fastener into the needle assembly for cutting and insertion. Such rotary feed systems, however, typically can be somewhat bulky and can create variation in a cut location. The filaments of the fastener stock typically have a desired amount of elasticity or flexibility and thus can stretch or expand by varying amounts as the filaments are engaged by the feed wheel, causing a variation or difference in the distance that the fastener stock is pulled forward. Thus, a variation or inconsistency is created in the cut location for successive fasteners cut from the fastener stock. These inconsistencies or variation in the location at which the fasteners are cut or severed from their fastener stock leads to inconsistent and reduced sizes of the side members of the plastic fasteners that in turn can lead to improper retention of the fastener in use. Such rotating feed wheel systems also can be somewhat complex and expensive in operation.

Accordingly, it can be seen that a need exists for a fastener and fastener stock system that addresses the foregoing and other related and unrelated problems in the art.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

It is an object of the present invention to provide a new and improved supply of substantially continuous fastener stock.

It is yet another object of the present invention to provide fastener stock as described above that is shaped to include a pair of longitudinal and continuous side members to which are coupled to a plurality of equidistantly spaced cross-pieces. The pair of longitudinal and continuous side members are extended in a parallel spaced relationship, and the series of cross-pieces are arranged at spaced intervals between the side members so as to connect the side members. Along at least one of the side members, a series of engagement notches are present at spaced intervals between each of said cross-pieces members, and the engagement notches are rectangular or square in shape.

It is still another object of the present invention to provide a method of applying a fastener to an article. The method includes a step of initially feeding a substantially continuous fastener stock from a supply, wherein the fastener stock includes a pair of longitudinal and continuous side members that are linked by cross-pieces, which are extended and arranged at spaced intervals along the side members. A second step where at least one engagement notch is formed along at least one of the side members and engaged with a feed mechanism. A third step where the fastener stock is urged forwardly with the feed mechanism. A fourth step where the fastener stock is fed to a needle assembly of a fastener dispensing system. A fifth step where a fastener is cut from the fastener stock at a cut location, and a final step where the fastener is inserted into the article.

It is yet another object of the present invention to provide fastener stock as described above that is shaped to include a pair of longitudinal and continuous side members to which are coupled to a plurality of equidistantly spaced cross-pieces. The pair of longitudinal and continuous side members are extended in a parallel spaced relationship, and the series of cross-pieces are arranged at spaced intervals between the side members so as to connect the side members. The pair or longitudinal and continuous side members and the cross-pieces both have a flat side. Along at least one of the side members, a series of engagement notches are present at spaced intervals between each of said cross-pieces members, and the engagement notches are rectangular or square in shape.

It is another object of the present invention to provide paddle fastener stock as described above that is shaped to include a longitudinal and continuous side member and a plurality of paddle heads to which are coupled to a plurality of equidistantly spaced cross-pieces. The longitudinal and continuous side member and paddle heads are extended in a parallel spaced relationship, and the series of cross-pieces are arranged at spaced intervals between the side member and paddle heads so as to connect the side member and paddle heads. The longitudinal and continuous side member, paddle heads, and the cross-pieces both have a flat side. Along the side member, a series of engagement notches are present at spaced intervals between each of said cross-pieces members, and the engagement notches are rectangular or square in shape.

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

The apparatuses and methods disclosed in this document are described in detail by way of examples and with reference to the figures. Unless otherwise specified, like numbers in the figures indicate references to the same, similar, or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to the figures.

Figure 1:
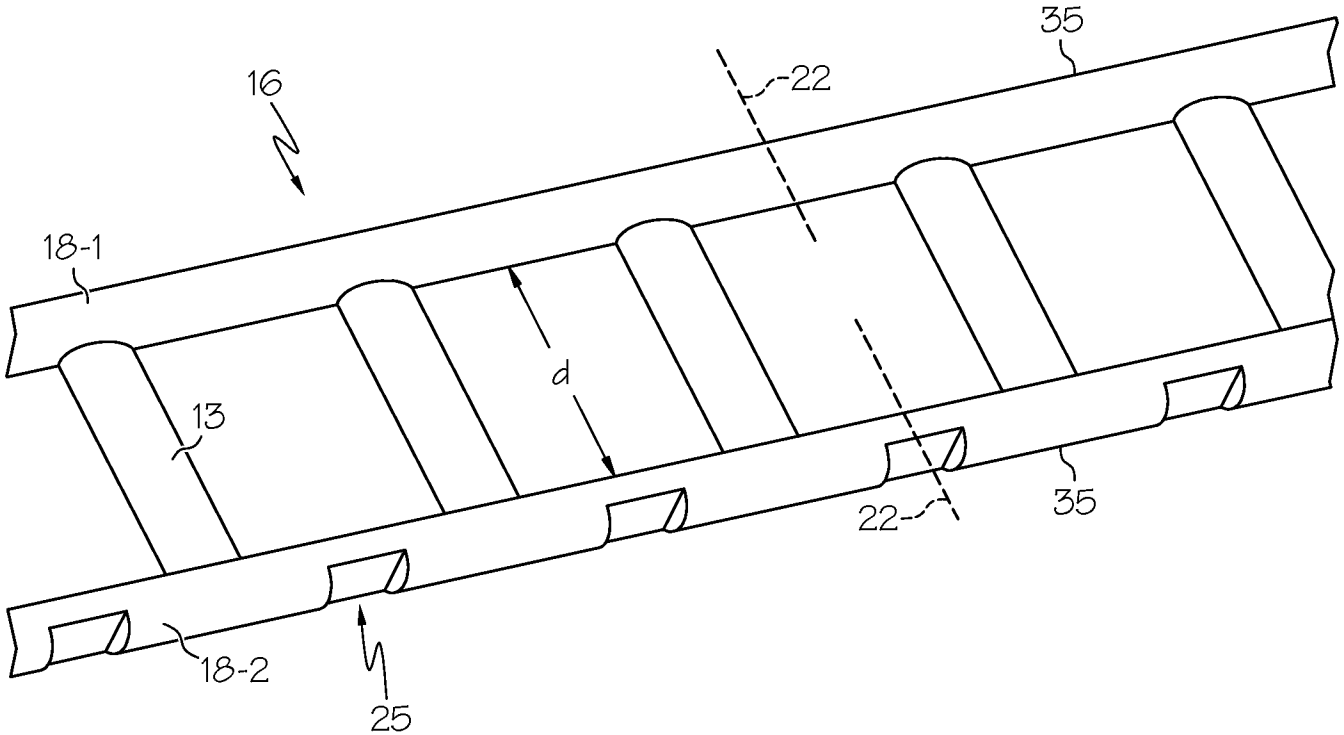
FIG. 1 is a perspective illustration of a length of continuously connected fastener stock.
Figure 3:
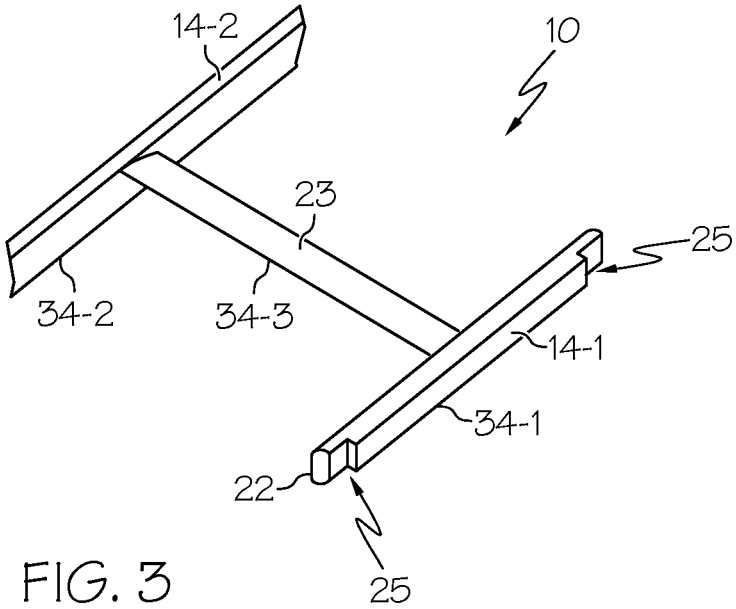
FIG. 3 is a perspective illustration of a fastener cut from the fastener stock according to the principles of the present invention.

FIG. 1 provides a perspective view of a length of continuously connected fastener stock 16 as constructed according to the teachings of the present invention. The fastener stock 16 includes a pair of longitudinal and continuous side members, or rails, 18-1 and 18-2 and plurality of equidistantly spaced cross-pieces 13. The fastener stock 16 comprises a plurality of connected fasteners, or staples, 10 (FIG. 3)

Figure 2:
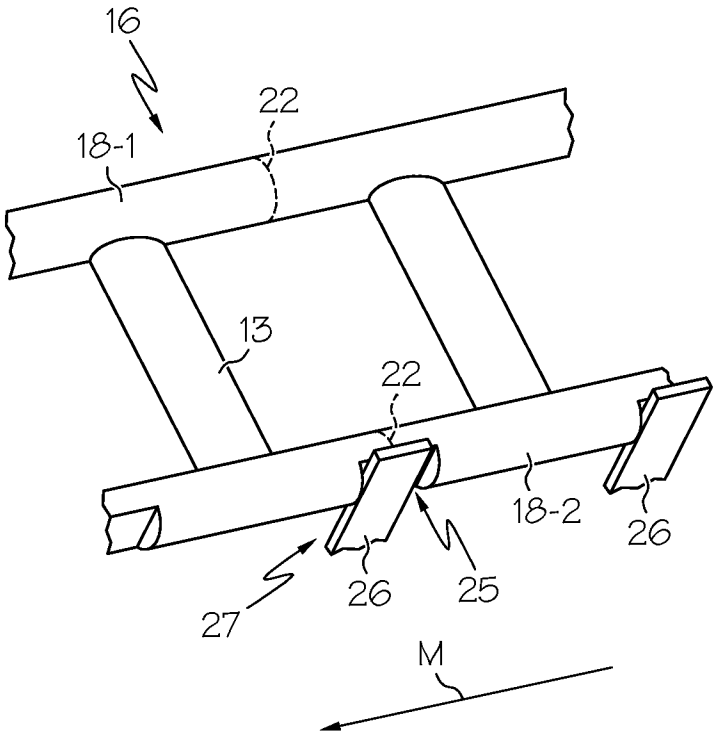
FIG. 2 is a perspective view schematically illustrating the fastener stock engaged by linearly moving fingers of a feed mechanism.

The side members 18-1 and 18-2 are spaced apart from one another by a desired fastener distance "d." Along one or both of side members 18-1 and 18-2, a series of engagement notches 25 generally will be formed. Each notch 25 will be formed at a location substantially corresponding to or in close proximity with an actual or desired cut location 22 for the fastener 10 (FIG. 2). The cut locations 22 on the side members 18-1 and 18-2 should be generally aligned or parallel with one another for consistent sized fasteners 10 (FIG. 3). The notches 25 will generally be on an outer side 35 of the side members 18-1 and 18-2, facing outward and away from the cross-pieces 13. The side members 18-1 and 18-2 can be of various lengths, intervals and thicknesses.

The cross-pieces 13 extend between the side members 18-1 and 18-2, connecting the side members 18-1 and 18-2 together. The cross-pieces 13 are arranged at spaced intervals along the side members 18-1 and 18-2. The cross-pieces 13 may be of a thinner or reduced cross-section as compared to the side members 18-1 and 18-2. Additionally, the desired approximate stretch range of the cross-pieces 13 can be varied depending upon the desired application of the fastener 10 (FIG. 3). The cross-pieces 13 can be of various lengths, intervals and thicknesses.

Fastener stock 16 differs principally from prior art fastener stock in that fastener stock 16 includes the series of notches 25 formed along the sides of the side members 18-1 and 18-2. Referring to FIG. 2, the notches 25 on the side member 18-2 assist in severing the fastener stock 16 at the proper cut location 22 to ensure consistent cutting of each fastener 10 (FIG. 3). For example, each notch 25 can be aligned with the cut location 22, or can be off-set, shifted approximately one pitch away, from the cut location 22. Typically, the notches 25 are approximately located at a midpoint between successive cross-pieces 13. The notches 25 further are shown as being substantially square or rectangular; however, other notch configurations also can be provided.

Figure 4:
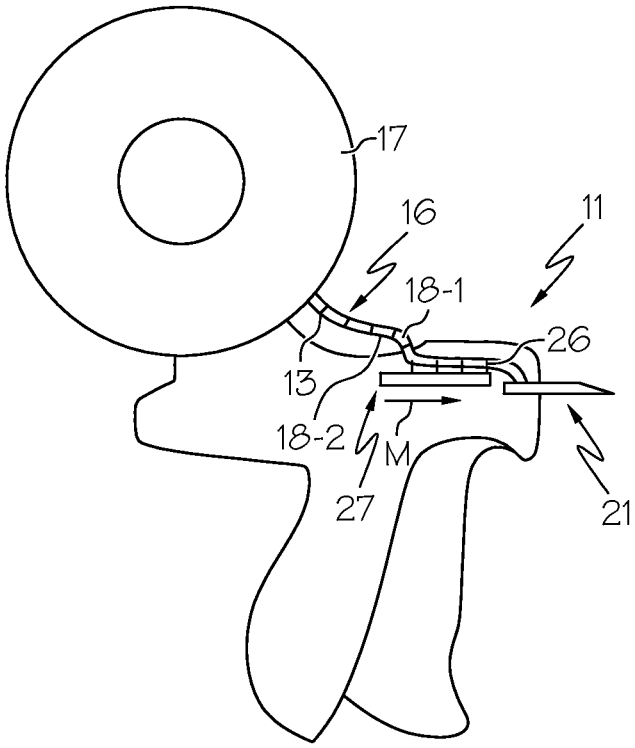
FIG. 4 is a perspective view of a fastener dispensing hand tool for applying fasteners.

As FIG. 2 indicates, the notches 25 in the side member 18-2 of the fastener stock 16 can be engaged by one or more linearly moving fingers, or pusher mechanisms, 26 of a feeding system 27 of the fastener dispensing system. Thus, instead of utilizing a rotary wheel that engages the cross-pieces 13, which can stretch or bend due to their inherent flexibility; the present invention enables the linearly moving fingers 26 to engage the side members 18-1 and 18-2 to feed the fastener stock 16 to a needle assembly 21 (FIG. 4). Unlike the cross-pieces 13, the side members 18-1 and 18-2 typically have less flexibility or range of stretching in their longitudinal direction indicated by arrow M. As a result, the side members 18-1 and 18-2 can provide enhanced consistency in engagement and forward movement by the linearly moving fingers 26 of the feed system 27. In addition, the notches 25 in the side members 18-1 and 18-2 assist in ensuring that consistently sized fasteners 10 (FIG. 3) are cut, engaged and inserted to a needle of a needle assembly 21 (FIG. 4).

Referring to FIG. 3, the severed fastener 10 is shown. By severing side members 18-1 and 18-2 (FIGS. 1 and 2) at the cut location 22 near the notches 25 and between successive cross-pieces 13 (FIGS. 1 and 2), a plurality of individual plastic fasteners 10 can be produced from the fastener stock 16 (FIGS. 1 and 2). The fastener 10 comprises a pair of cross-bars 14-1 and 14-2 that are interconnected by a thin, flexible filament 23. Cross-bars 14-1 and 14-2 are derived from side members 18-1 and 18-2 (FIGS. 1 and 2), respectively, and filament 23 is derived from a corresponding cross-piece 13 (FIGS. 1 and 2). Depending upon the desired size, the fastener 10 may consist of cross-bars 14-1 and 14-2 with notches 25 present.

The fastener stock 16 (FIGS. 1 and 2) is generally formed by an extruding or molding process of a plastic or synthetic material such as polypropylene, polyurethane, nylon, polyvinyl chloride, or other similar durable, flexible thermo-plastic or elastomeric materials. Preferably, the plastic or synthetic material of the fastener will be both sufficiently flexible along the filaments 23, and sufficiently stiff along its cross-bars 14-1 and 14-2 so that the fastener 10 can be easily inserted and pushed through a needle slot of the needle assembly 21 (FIG. 4). In addition, the cross-bars 14-1 and 14-2 (FIG. 3) of the fastener 10 must be a sufficient size and/or length to function properly and securely hold the article so that the fastener 10 has sufficient strength to hold or be retained within garments, paper, fabrics or other articles.

From the manufacturing process by which the fastener stock 16 (FIGS. 1 and 2) is formed, a transverse cross-section of cross-bars 14-1 and 14-2 and flexible filament 23 are generally in the form a flattened semi-ellipse, or flattened semi-oval, that includes a flat bottom surface on sides 34-1, 34-2, and 34-3. This creates a D-shaped profile with opposing inner and outer surfaces that are generally flat with a rounded top surface. However, it is to be understood that the transverse cross-section of each of side members 18-1 and 18-2 and cross-pieces 13 could be modified without departing from the spirit of the present invention.

As indicated in FIG. 4, the fastener stock 16 can be stored or wound about a storage reel 17 for feeding to the fastener dispensing system. The fastener stock 16 of the present invention may have a particular elasticity, which allows the fastener stock 16 to be wound upon itself and to travel through the needle assembly 21. To attach the fastener 10 (FIG. 3) to an article, the fastener stock 16 is fed from a supply such as the storage reel 17. As indicated by arrow M, the notches 25 (FIG. 1-3) along the side members 18-1 and 18-2 are engaged in a forward direction by the feed mechanism 27. The feed mechanism 27 consists of the linearly moving fingers 26 that engage the notches 25 (FIGS. 1-3). Similarly, the fastener stock 16 is urged in the forward direction by the feed mechanism 27. The fastener stock 16 is then fed to the needle assembly 21 of the fastener dispensing system, which is depicted as a hand tool 11 in FIG. 4. The individual fasteners 10 (FIG. 3) are severed from the fastener stock 16 at the cut locations 22 (FIGS. 1 and 2) along the side members 18-1 and 18-2. The notches 25 (FIGS. 1-3) assist in determining the cut locations 22 (FIGS. 1 and 2) for the individual fasteners 10 (FIG. 3). Typically, the cut locations 22 (FIGS. 1 and 2) will be around the notches (FIGS. 1-3) and approximately centered between the cross-pieces 13. Once cut, the fastener 10 (FIG. 3) is inserted into the article by the needle assembly 11. In addition to the hand tool 11, the fastener stock 16 may be utilized by any complimentary fastener dispensing system such as a variable needle stapling assembly.

Figure 5A:
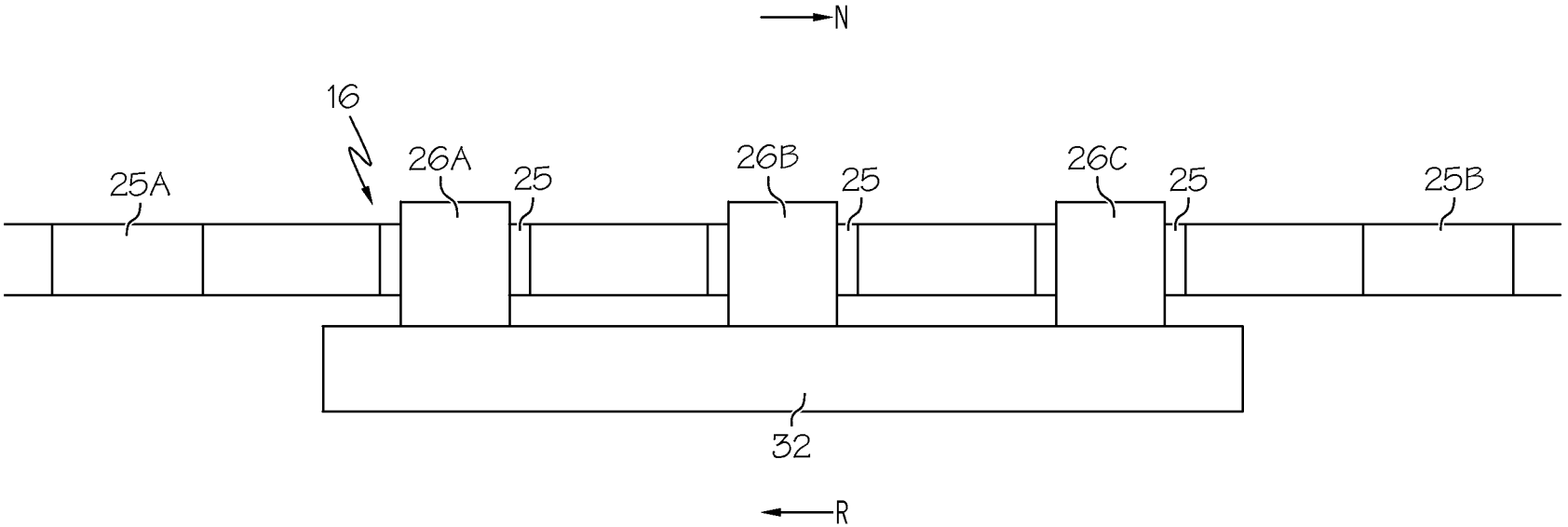
FIG. 5A is a side view illustrating the fastener stock engaged by linearly moving fingers utilizing a tract mechanism.

In addition to the feed mechanism 27 (FIG. 4) described, FIG. 5A demonstrates how multiple linearly moving fingers 26A, 26B and 26C engage the notches 25 on the fastener stock 16 toward the needle assembly 21 (FIG. 4). The linearly moving fingers 26A, 26B and 26C can be mounted on a track 32 that is incrementally indexed forwardly, indicated by arrow N, with each activation of the needle assembly 21 (FIG. 4). Immediately before the fastener stock 16 reaches the needle assembly 21 (FIG. 4), the linearly moving fingers 26A, 26B and 26C disengage with the notches 25. Once disengaged, the linearly moving fingers 26A, 26B and 26C can be retracted in an opposite direction, indicated by arrow R. A notch 25B in the fastener stock 16 continues to travel forward to the needle assembly 21 (FIG. 4), and the linearly moving fingers 26A, 26B and 26C move into engagement with a next set of notches 25A.

Figure 5B:
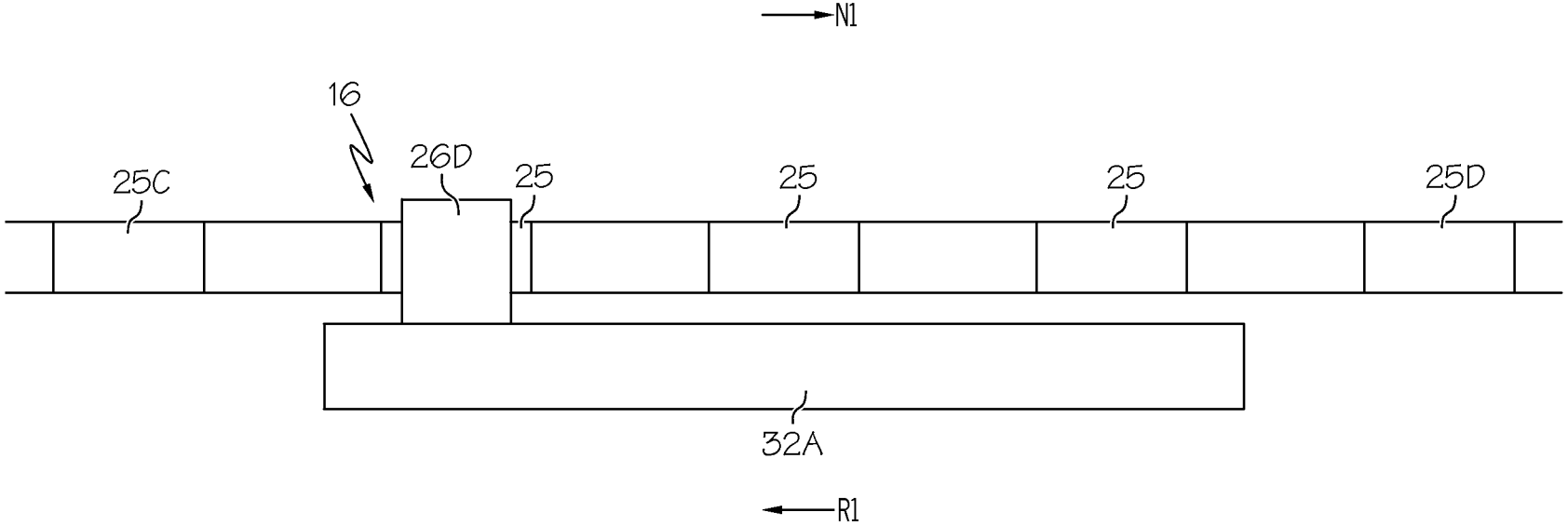
FIG. 5B is a side view illustrating the fastener stock engaged by a linearly moving finger utilizing a tract mechanism.

In addition to the embodiment described in FIG. 5A, FIG. 5B depicts only a single linearly moving finger 26D to engage the notch 25 of the fastener stock 16. The single linearly moving finger 26D is mounted to a track 32A that is incrementally indexed forwardly, indicated by arrow N1, with each activation of the needle assembly (FIG. 4). Immediately before the fastener stock 16 reaches the needle assembly 21 (FIG. 4), the linearly moving finger 26D disengages with the notch 25. Once disengaged, the linearly moving finger 26D can be retracted in an opposite direction, indicated by arrow R1. A notch 25D in the fastener stock 16 continues to travel forward to the needle assembly 21 (FIG. 4), and the linearly moving finger 26D moves into engagement with a next notch 25B.

Figure 6:
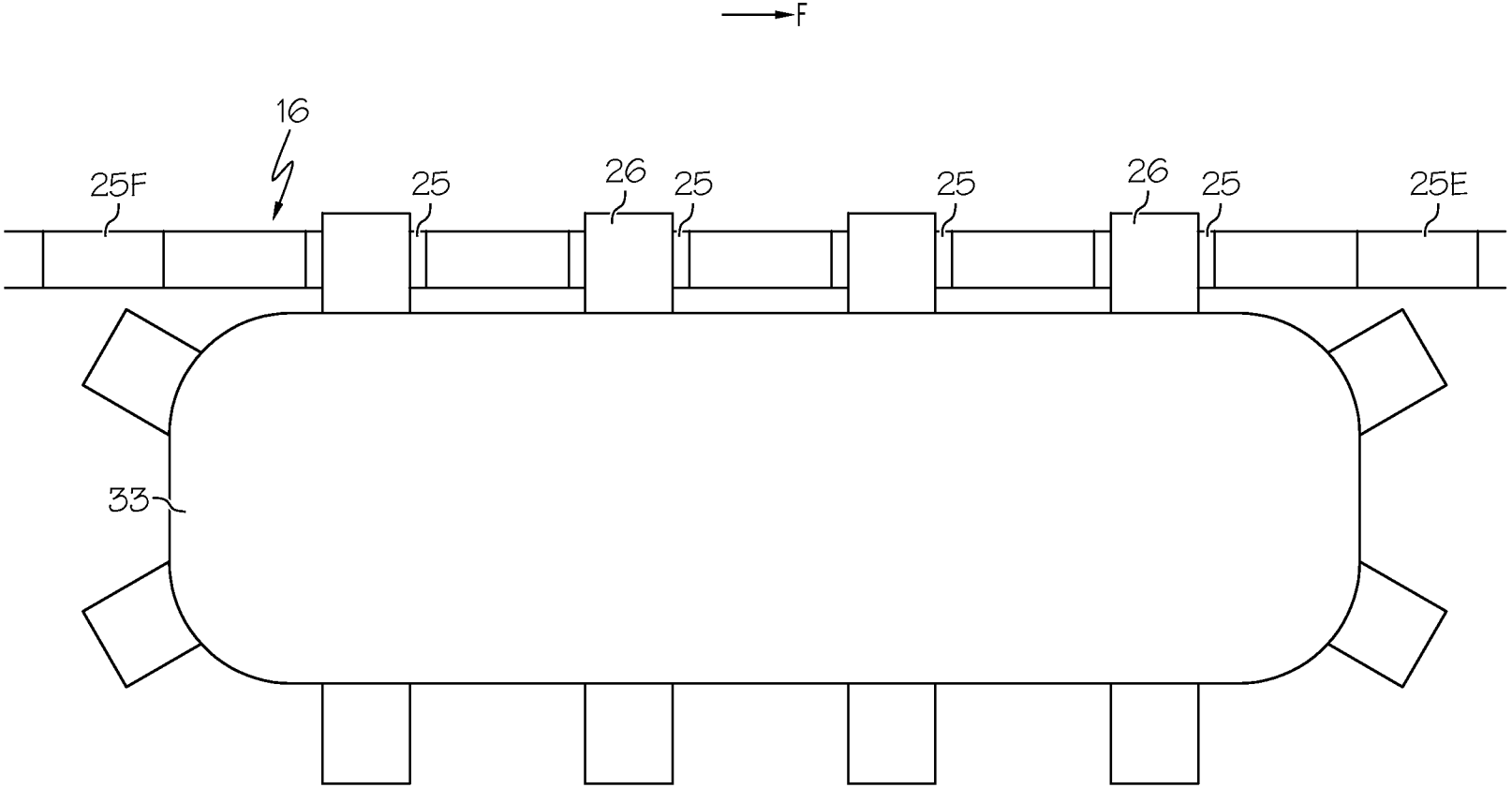
FIG. 6 is a side view illustrating the fastener stock engaged by linearly moving fingers utilizing a carousel structure.

Alternatively in FIG. 6, one or more linearly moving fingers 26D can be mounted on an elliptical belt or carousel structure 33 that incrementally moves the linearly moving fingers 26D forward as indicated by arrow F, and thus the fastener stock 16 moves forwardly along a desired length of linear travel. Immediately before the fastener stock 16 reaches the needle assembly 21 (FIG. 4), the linearly moving fingers 26 disengages with the notches 25. Once disengaged, the linearly moving fingers 26 are disengaged and move along a return path. A notch 25E in the fastener stock 16 continues to travel forward to the needle assembly 21 (FIG. 4), and the linearly moving fingers 26D move into engagement with a next notch 25F.

In addition to the embodiments described, other feed systems may be utilized including a rotary wheel type feed mechanism for the fastener dispensing system.

Figure 7:
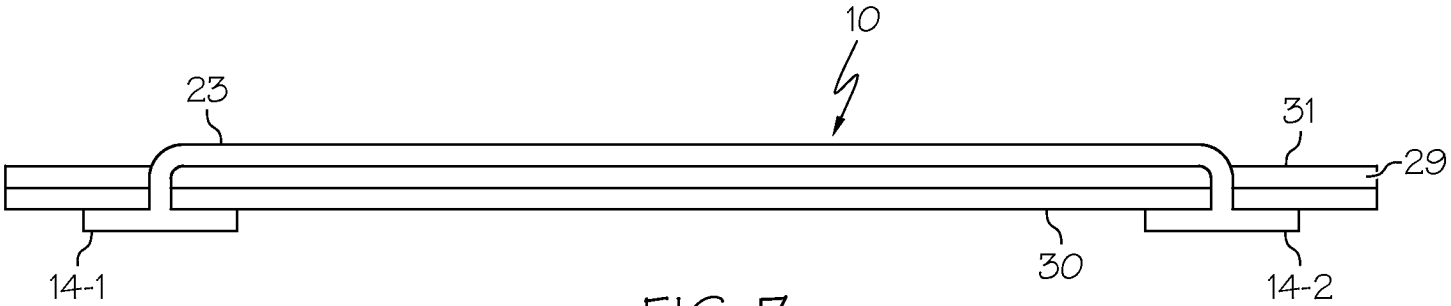
FIGS. 7 and 8 are side views illustrating the fasteners applied to articles of different thicknesses.
Figure 8:
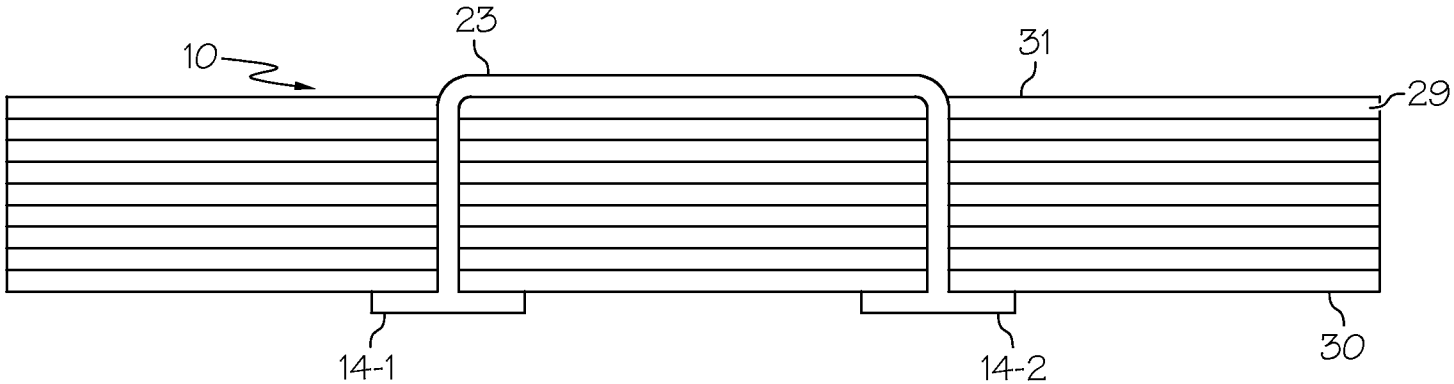

Once the fastener stock 16 is cut, the severed fastener 10 (FIG. 3) is inserted into articles using the fastener dispensing system. FIGS. 7 and 8 illustrate the attachment of the fastener 10 in different configurations to secure stacks of articles 29 of varying thicknesses and shapes. In FIG. 7, the fastener 10 is securing two stacks of articles 29, while in FIG. 8, the fastener 10 is securing eight stacks of articles 29. In FIGS. 7 and 8, the cross-bars 14-1 and 14-2 secure an article back 30 while the filament 23 punctures through the stacks of articles 29 and wraps around an article front 31. The filament 23 provides flexibility and a desired approximate amount of stretch to the fastener 10, which enables use in different fastening configurations. FIGS. 7 and 8 demonstrate how the fastener 10 may be used to secure stacks of articles 29; however, the fastener 10 may be used in a variety of applications including packaging and tagging materials.

Additionally, while the fastener 10 (FIG. 3) of the present invention generally has been illustrated as the plastic staple or T-end type fastener, various plastic fasteners of other configurations such as paddle fasteners and loop fasteners can also be formed in accordance with the principles of the present invention.

Figure 9:
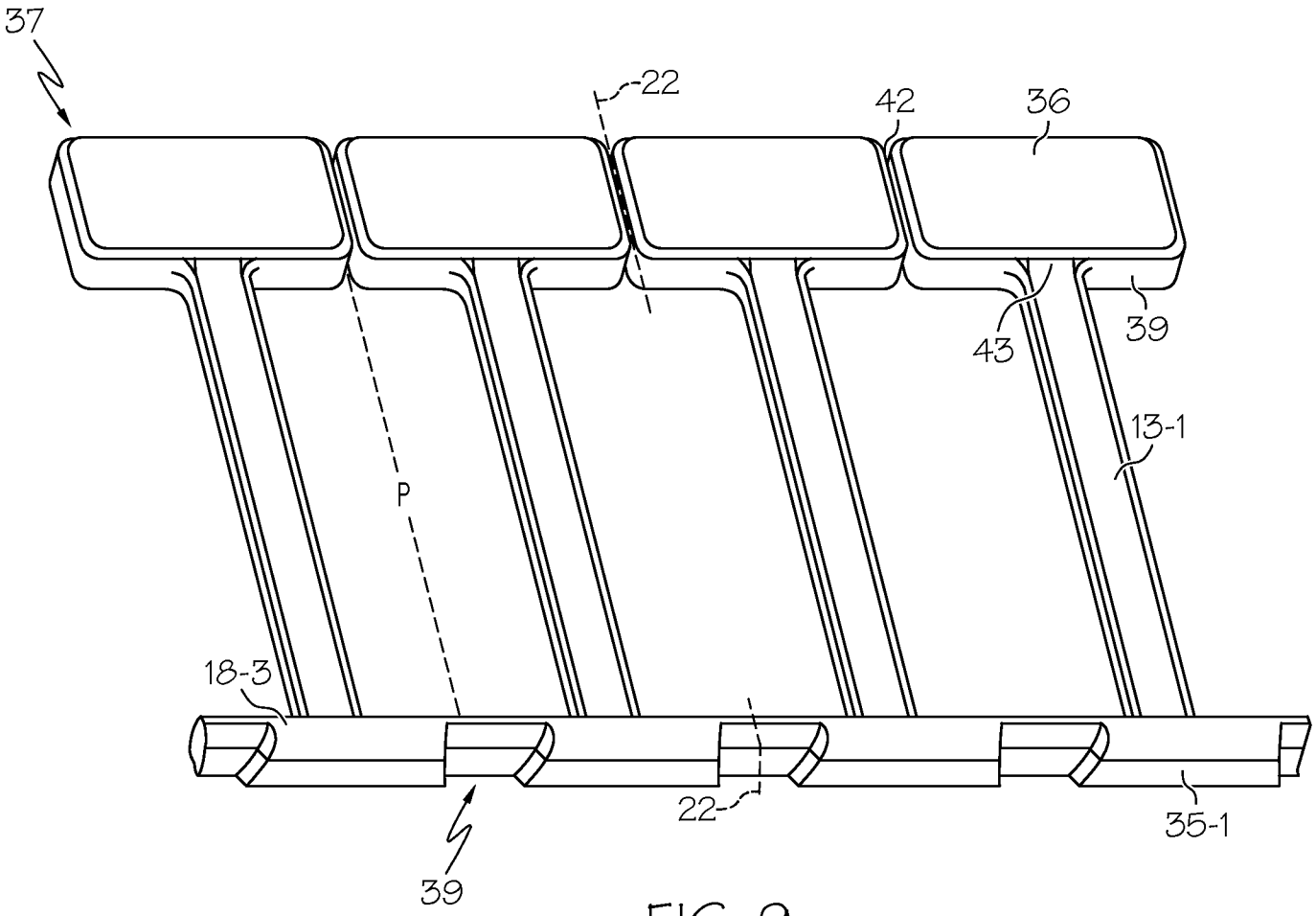
FIG. 9 is a perspective view of a length of continuously connected paddle fastener stock.
Figure 10:
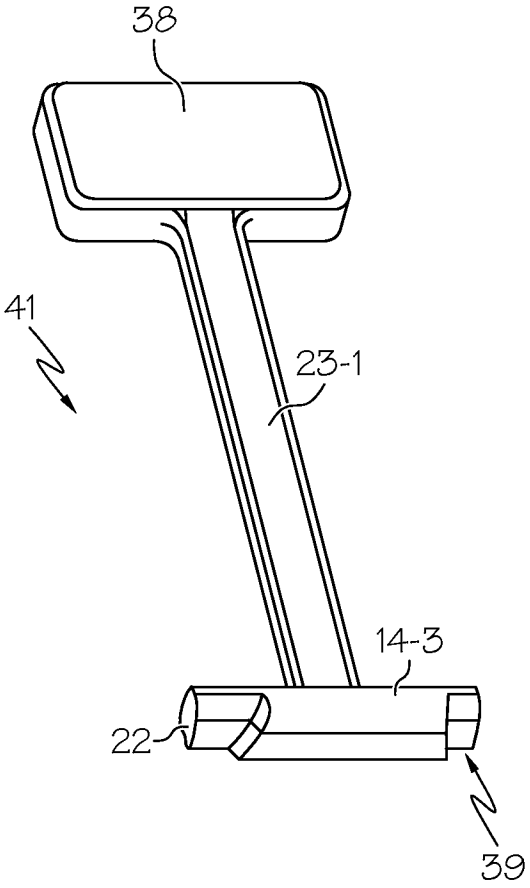
FIG. 10 is a perspective illustration of a paddle fastener cut from the paddle fastener stock.

FIG. 9 provides a perspective view of a length of continuously connected paddle fastener stock 37. The paddle fastener stock 37 includes one longitudinal and continuous side member, or rail, 18-3, a plurality of paddle heads 36, and plurality of equidistantly spaced cross-pieces 13-1. The paddle fastener stock 37 comprises a plurality of connected paddle fasteners 41 (FIG. 10)

The paddle heads 36 and the side member 18-3 are spaced apart from one another by a desired fastener distance "p" and are parallel to one another. Along the side member 18-3, a series of engagement notches 39 generally will be formed. Each notch 39 will be formed at a location substantially corresponding to or in close proximity with an actual or desired cut location 22 for the paddle fastener 41 (FIG. 10). The cut locations 22 on the side member 18-3 should be generally aligned or parallel with one another for consistent sized paddle fasteners 41 (FIG. 10). The notches 39 will generally be on an outer side 35-1 of the side member 18-3, facing outward and away from the cross-pieces 13-1. The side member 18-3 can be of various lengths, intervals and thicknesses.

The paddle heads 36 are interconnected along a rectangular side portion 42. The paddle heads 36 are typically rectangular in shape and may have rounded or pointed corners. The paddle heads 36 are connected to the cross-piece 13-1 by attaching near a midpoint 43 along an inner wall 39 of the paddle head 36. The paddle heads 36 can be of various lengths, intervals and thicknesses.

The cross-pieces 13-1 extend between the side member 18-3 and the paddle heads 36, connecting the side member 18-3 and the paddle heads 36 together. The cross-pieces 13-1 are arranged at spaced intervals along the side member 18-3 and paddle heads 36. The cross-pieces 13-1 may be of a thinner or reduced cross-section as compared to the side member 18-3. Additionally, the desired approximate stretch range of the cross-pieces 13-1 can be varied depending upon the desired application of the paddle fastener 37 (FIG. 10). The cross-pieces 13-1 can be of various lengths, intervals and thicknesses.

Referring to FIG. 10, the severed paddle fastener 41 is shown. By severing the side member 18-3 (FIG. 9) and paddle heads 36 (FIG. 9) at the cut locations 22 near the notches 39 and between successive cross-pieces 13-1 (FIG. 9), a plurality of individual plastic paddle fasteners 41 can be produced from the paddle fastener stock 37 (FIG. 9). The paddle fastener 41 comprises a cross-bar 14-3 and a rectangular portion 38 that are interconnected by a thin, flexible filament 23-1. Cross-bar 14-3 is derived from side member 18-3 (FIG. 9), and filament 23-1 is derived from a corresponding cross-piece 13-1 (FIG. 9). The rectangular portion 38 is derived from the interconnected paddle heads 36 (FIG. 9) along the rectangular side portion 42 (FIG. 9). Depending upon the desired size, the paddle fastener 41 may consist of cross-bar 14-3 with notches 39 present.

A transverse cross-section of cross-bar 14-3, rectangular portion 38, and flexible filament 23-1 are generally in the form a flattened semi-ellipse, or flattened semi-oval, that includes a flat bottom surface on sides. This creates a D-shaped profile with opposing inner and outer surfaces that are generally flat with a rounded top surface. However, it is to be understood that the transverse cross-section of each of side member 18-3 (FIG. 9) and cross-pieces 13-1 (FIG. 9) could be modified without departing from the spirit of the present invention.

Similar to the fastener stock 16 (FIG. 1), the paddle fastener stock 37 (FIG. 9) may be used by fastener dispensing systems.

It will thus be seen according to the present invention a highly advantageous notched fastener has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A method of applying a fastener to an article, comprising:

feeding a substantially continuous fastener stock from a supply, said fastener stock including a pair of longitudinal side members linked by cross-pieces extended therebetween and arranged at spaced intervals along the side members with engagement notches formed on an outer side of the side members and facing outward and away from the cross pieces;

engaging at least one said engagement notch formed along at least one of said side members with a feed mechanism urging said fastener stock in a forward direction forwardly away from the supply with said feed mechanism;

feeding said fastener stock to a needle assembly of a fastener dispensing system;

cutting a fastener from said fastener stock at a cut location; and inserting said fastener into said article.

2. The method of claim 1 wherein during feeding of the fastener stock, said at least one engagement notch-of said at least one side member is engaged by at least a linearly moving finger so that said fastener stock can be incremented in the forward direction along a substantially linear path of travel for separation of individual fasteners therefrom.

3. The method of claim 2 wherein the fastener dispensing system is a needle stapling assembly having a needle assembly such that before the fastener stock reaches the needle assembly the linearly moving finger disengages with the at least one engagement notch.

4. The method of claim 1 wherein the step of urging the fastener stock forwardly with said feed mechanism comprises moving said fastener stock incrementally forwardly along a linearly extending path of travel at a location of notch engagement.

5. The method of claim 1 wherein said fastener dispensing system is a dispensing hand tool.

6. The method of claim 1 wherein said fastener dispensing system is a variable needle stapling assembly.

7. The method of claim 1 wherein the step of urging the fastener stock forwardly with said feed mechanism comprises moving said fastener stock incrementally forwardly along a track that may also retract to engage a next engagement notch.

8. The method of claim 1 wherein the step of urging the fastener stock forwardly with said feed mechanism comprises moving the fastener stock incrementally in the forward direction along a carousel structure.

9. The method of claim 1 wherein feeding said fastener stock from said supply comprises pulling said fastener stock from a supply roll upon at least one engagement of said engagement notches of said fastener stock by said feed mechanism.

10. The method of claim 1 wherein the cross-pieces are equidistantly spaced.

11. The method of claim 1 wherein the fastener stock is if-formed by an extruding or molding process of a plastic or synthetic material.

12. The method of claim 1 wherein the cut location is around the at least one notch.

13. The method of claim 1 wherein the cut location is centered between the cross pieces.

14. The method of claim 1 wherein the fastener stock is paddle fastener stock.

15. The method of claim 1 wherein the fastener cut from the fastener stock comprises a pair of cross bars that are interconnected by a filament.

16. The method of claim 15 wherein the inserting of said fastener includes the cross-bars securing said article back while the filament punches through a stack of articles.

* * * * *